US007101064B2

(12) United States Patent
Ancel

(10) Patent No.: US 7,101,064 B2
(45) Date of Patent: Sep. 5, 2006

(54) LOADING DOCK LIGHT SYSTEM

(76) Inventor: Thomas A. Ancel, Beacon Industries, 7321 S. Lindberg Blvd., St. Louis, MO (US) 63125

( * ) Notice: Subject to any disclaimer, the term of this patent is extended or adjusted under 35 U.S.C. 154(b) by 165 days.

(21) Appl. No.: 10/072,860

(22) Filed: Feb. 9, 2002

(65) Prior Publication Data

US 2003/0151912 A1 Aug. 14, 2003

(51) Int. Cl.
*F21S 8/00* (2006.01)
*F21V 17/02* (2006.01)

(52) U.S. Cl. ..... 362/427; 362/145; 362/449

(58) Field of Classification Search ..... 362/145, 362/427, 547, 523, 418, 430, 432, 294, 370, 362/371, 373, 152, 431, 449, 368
See application file for complete search history.

(56) References Cited

U.S. PATENT DOCUMENTS 4,973,016 A * 11/1990 Hertenstein ..... 362/432
5,258,898 A * 11/1993 Thornton ..... 362/394
5,709,458 A * 1/1998 Metz ..... 362/96
6,634,139 B1 * 10/2003 Metz ..... 49/13
6,812,849 B1 * 11/2004 Ancel ..... 340/686.1

* cited by examiner

*Primary Examiner*—Ali Alavi
*Assistant Examiner*—Bao Q. Truong
(74) *Attorney, Agent, or Firm*—Henry W. Cummings

(57) ABSTRACT

The present invention is a device, which illuminates light inside of a tractor trailer truck van and other loading vehicles at a loading dock during loading and unloading procedures. As professionals working with such vehicles understand, natural lighting is simply not enough to prevent serious loading and unloading accidents, primarily at the deep end of the truck trailer van body. The loading dock spot light of the present invention with its short body design helps prevent fork trucks from hitting and destroying it. The overall short body of the light structure is designed to stay out of the primary main path of the fork truck traffic, allowing the light emitted from the light bulb to just peek beyond the loading dock door seal edge. The present invention is a simple mechanical device, which reduces loading dock operator confusion during loading and unloading operation, maintenance, and repair.

33 Claims, 11 Drawing Sheets

LOADING DOCK LIGHT SYSTEM

I FIELD OF THE INVENTION

This invention relates to short body design loading dock spot lights, and more particularly to loading dock spot light application while a tractor trailer van is parked adjacent to a loading dock. The device produces light in the tractor trailer van during loading and unloading procedures.

II BACKGROUND OF THE INVENTION

The standard loading dock lights for loading and unloading tractor trailer vans usually have long cumbersome arms and get damaged easily in heavy traffic areas at loading dock facilities. Loading dock lights with arms, elbows or extensions break in usage over time. They are costly to keep repairing, costly with the down time of no light when broken and get in the way of the forklift, forklift driver and payload. The short body pipe mount and door jamb loading dock spot light is an economical alternative. The standard loading dock lights for loading and unloading tractor trailer vans usually have long cumbersome arms and get damaged easily in heavy traffic areas at loading dock facilities. Many loading dock spot lights have been developed to light a tractor trailer van or other vehicles.

For example, U.S. Pat. No. 5,709,458 discloses a dock light. This invention requires a powered cooling fan to prevent the unit from overheating. It is also extensible by means of a gooseneck arrangement. Such an arrangement can be susceptible over time to wear and the effects of gravity. The present invention does not use such a system.

U.S. Pat. No. 5,357,414 discloses a modular cantilevered electrical light fixture. The nature of a cantilevered light is susceptible over time to wear and the effects of gravity. The present invention does not use such a system.

U.S. Pat. No. 4,973,016 discloses a dock fan and light cantilever-mounted articulated multi-arm utility support assembly. As in the prior inventions, a cantilevered light is susceptible over time to wear and the effects of gravity. The present invention does not use such a system.

U.S. Pat. No. 5,258,898 discloses an electrical lighting support assembly. As in the prior inventions, a cantilevered light is susceptible over time to wear and the effects of gravity. The present invention does not use such a system.

U.S. Pat. No. 4,880,193 discloses a less than 360 degree lamp swivel. This invention describes a swivel which connect two or more articulated swing arms mounted to a fixed structure on one end with a lamp on the other end. As described herein, such an arrangement is susceptible over time to damage, wear, and the effects of gravity. The present invention mounts directly to a solid structure, which renders it less vulnerable to damage and wear.

U.S. Pat. No. 4,726,552 discloses a lamp swivel. Again, this invention describes articulated cantilevered arms which will droop over time, and are more vulnerable to external damage than is the present invention U.S. Pat. No. 4,319,314 discloses a light fixture with internal connection zone. This invention is concerned with means to connect internal lamp wiring in a tubular, extended arm.

U.S. Pat. No. 4,814,955 discloses a swivel device for mounting a spotlight. This invention is limited to a bidirectional swivel mount for a light, not specific to a loading dock.

U.S. Pat. No. 5,213,413 discloses a combined light and light support bracket. This invention uses an articulated support arm with a junction box and switch arrangement mounted near the light fixture itself. This invention is highly susceptible to damage from fork lift trucks and the like.

III SUMMARY OF THE INVENTION

A. Objects of the Invention

One object of the present invention is to provide a means to light inside a semi tractor trailer truck van during loading and unloading.

Another object of the present invention is to provide a frame structure that is cool to the touch without the cooling requirements of fans or large head body designs.

Another object of the present invention is to provide a frame structure that is short without the requirements of arms, elbows or extension tubes. The less moving parts the stronger the unit and the longer it will last.

Another object of the present invention is to provide a frame structure which may be mounted on a left hand or right hand structure without requiring different parts specific to a left or right hand mounting.

B. Summary

The present invention is a device, which illuminates light inside of a tractor trailer truck van and other loading vehicles at a loading dock during loading and unloading procedures. As professionals working with such vehicles understand, natural lighting is simply not enough to prevent serious loading and unloading accidents, primarily at the deep end of the truck trailer van body. The loading dock spot light of the present invention with its short body design helps prevent fork trucks from hitting and destroying it. The overall short body of the light structure is designed to stay out of the primary main path of the fork truck traffic, allowing the light emitted from the light bulb to just peek beyond the loading dock door seal edge. The present invention is a simple mechanical device, which reduces loading dock operator confusion during loading and unloading operation, maintenance, and repair.

The present invention is designed for horizontal axis movement. This rotation allows for the light body structure to move forward out of the way in the event the light body structure is hit by a fork truck from the rear as the fork truck is entering into the truck trailer van. Furthermore, this rotation allows for the light body structure to move backwards out of the way in the event the light body structure is hit by a fork truck from the front as the fork truck is departing out of the truck trailer van body. The vertical angle rotation setting of the internal light bulb of the present invention for optimum lighting is determined by the average length of inside tractor trailer vans that are being serviced. The internal mounting frame for the light bulb has a predetermined horizontal and vertical angle degree mounting bracket. The degree of the internal mounting frame setting angle is determined by the flood degree of light bulb along with the average distance length of the truck trailer van. The internal main frame light housing fixture of the light body structure that holds the light bulb is mounted on a universal frame with ability to rotate 180 degrees during production. Since the light body structure of the present invention is universal, it can be mounted as a left or a right side application of the dock door opening. Therefore, when the light body structures of the present invention are assembled, the internal frame can be rotated 180 degrees for the proper left or right side application to create a uniform horizontal light angle for both sides, either a right or a left loading dock door mounting application.

The light body structure is designed to house an inexpensive standard par 30 small diameter Halogen light bulb. The light body structure of the present invention is designed to use the light bulb illuminator, no large light housing head refractor is required. The light bulb face located in the present invention is behind the front face of the light body structure front plane of impact. The light body structure of the present invention is designed of strong metal, metal alloy or strong plastic for the purpose of taking an impact from a fork truck before the light bulb front face is hit. Commonly used loading dock light heads or structures as seen today in the industry are not designed to be hit by a fork truck. The heads of the commonly used loading dock lights only act as illuminators.

The present invention is an environmentally cooled structure to be manually moved for proper light positioning during loading and unloading procedures within the truck trailer van. The light body structure of the present invention has breather holes to keep the light body structure cool to the touch. This light body structure has the proper internal breathing space design around the light bulb as to keep the light body structure cool. Similarly, dangers normally associated with hot bodied loading dock lights that are found in the industry are too hot to touch after several hours of operation, and the like, place the loading dock operator at risk of getting burned. Fans, parts, and electricity are not required to keep the light body structure cool to the touch as found and associated with fan cooled loading dock lights. The light body structure of the present invention is designed to be short and stout to its mounting point. The light body structure of the present invention is designed not to have sagging arms or tubes as many other loading dock lights do have these occurrences after usage in time. The arms, tubes or extensions of other loading dock lights sag over time due to the cantilever effect of the loading dock light load and mounting designs, and in use tend to get hit by the fork trucks.

IV. THE DRAWINGS

V. DESCRIPTION OF PREFERRED EMBODIMENTS

Figure 1:
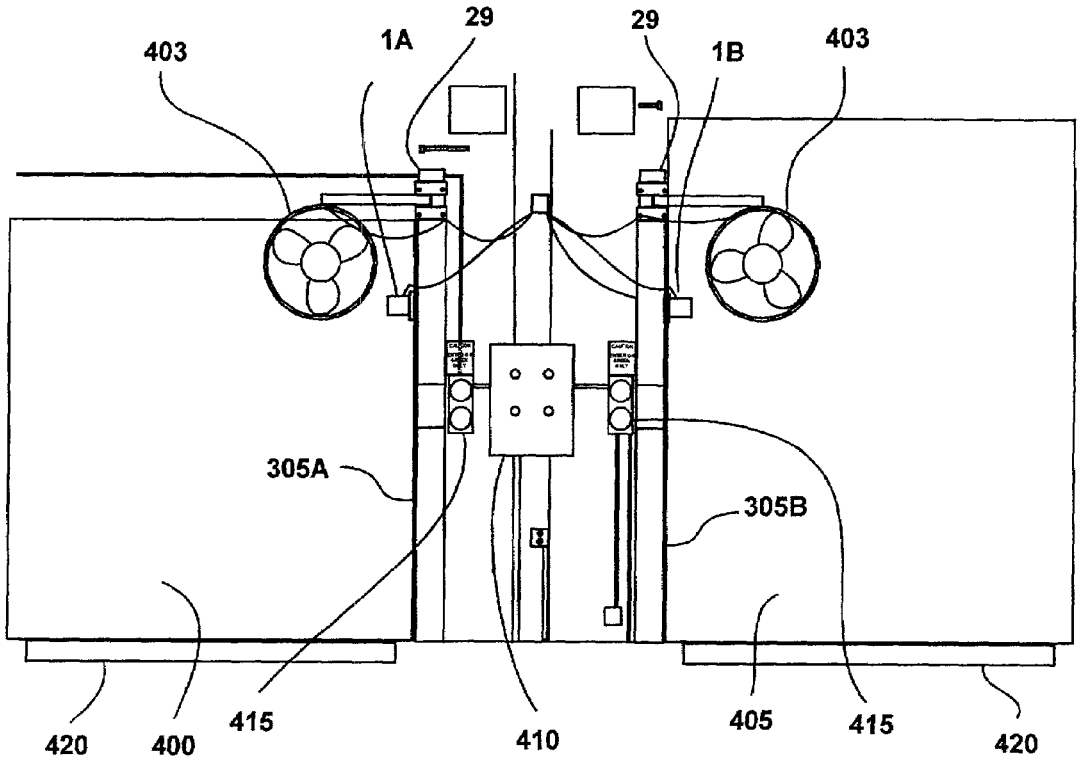
FIG. 1 is a view of a typical installation of the short body pipe mounting loading dock spotlight in a loading dock application.
Figure 2A:
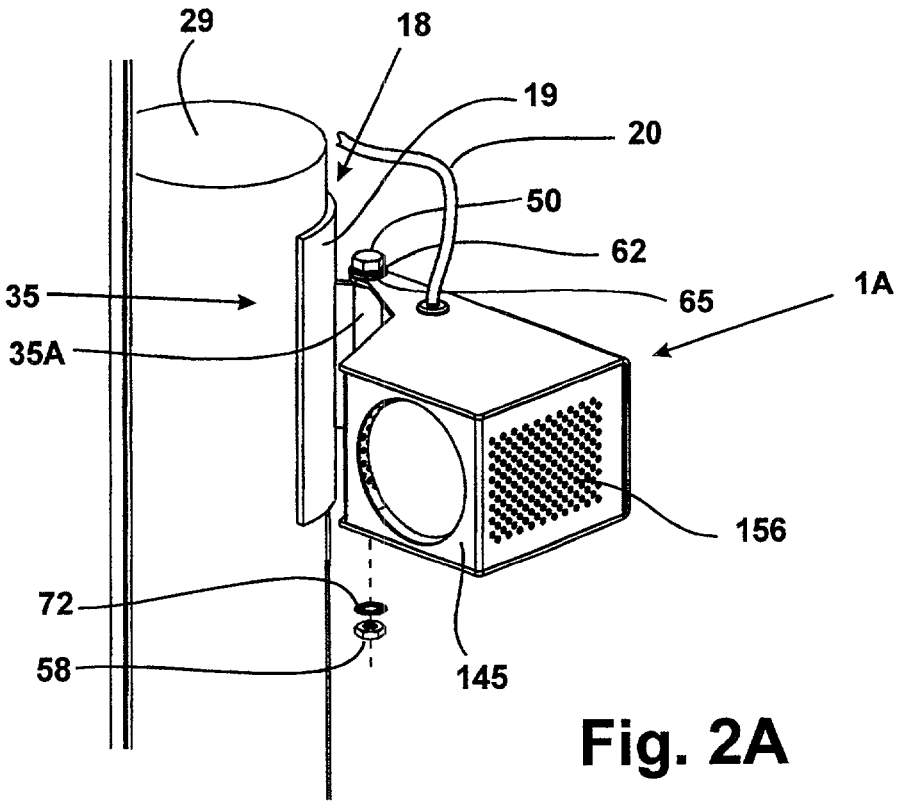
FIG. 2A is a perspective view of the short body pipe mount loading dock spot light of the present invention mounted on the right pipe bollard.
Figure 2B:
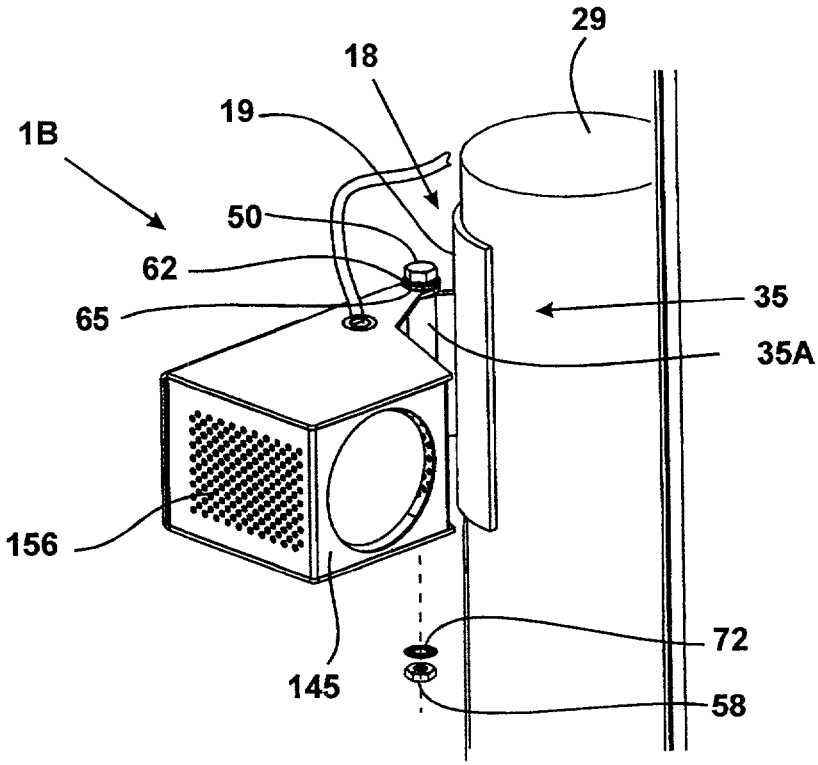
FIG. 2B is a perspective view of the short body pipe mount loading dock spot light of the present invention mounted on the left pipe bollard.
Figure 3:
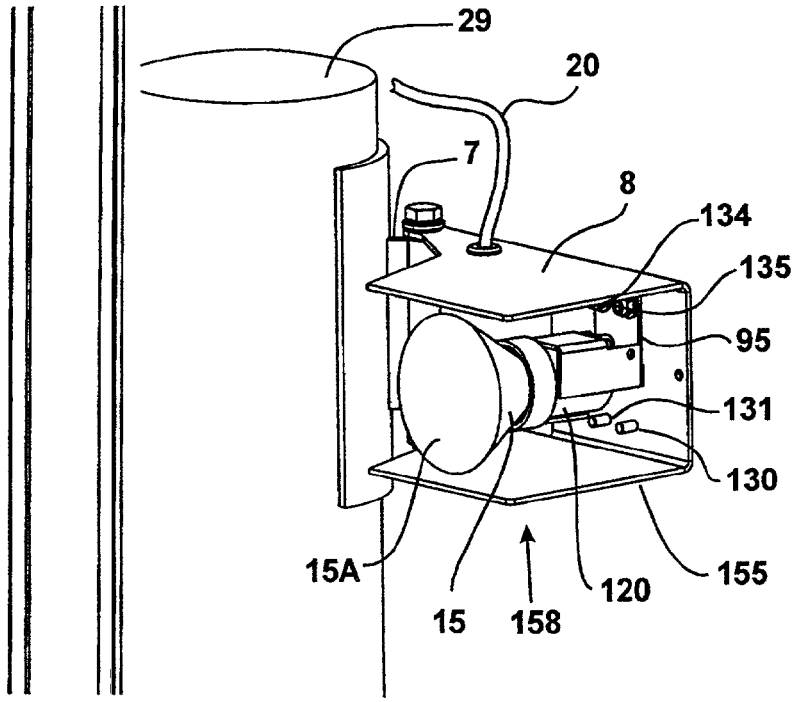
FIG. 3 is a perspective view of the short body pipe mount loading dock spot light with the front cover removed illustrating the light bulb, light bulb fixture bracket and cooling space design of the present invention.

FIGS. 1 through 7D illustrate the Pipe Mount Loading Dock Light embodiment of the device of the present invention.

In accordance with the present invention, pipe mount assemblies 1A, 1B are shown in a typical installation (FIG. 1), mounted to pipe bollards 29. Some or all of the following items may not be present in all installations: Left door 400, right door 405, right door jamb 305A, left door jamb 305B, dock levelers 420, cooling fans 403, traffic signal lights 415, and control panel 410.

An advantage of the pipe mount 1A, 1B of the present invention is to provided a thick strong curved plate 19, frame 7, and housing 8 that has abetter ability to take the rugged day to day operations than the current loading dock light designs with arm extensions, tubes and elbows.

Another advantage of the current invention is utilizing the location of the light bulb center line 10 (FIG. 6) in place of long arms and elbowed structures. The proper lighting geometry of the present invention increases the life of the overall frame body structure 7, 8 in comparison to the present loading dock lights with extension arms, tubes and elbows. With the light body structure having its reduced exposure in the traffic area, the light bulb 15 (FIG. 3) filament life increases as compared to the current loading dock lights with long arm extensions, tubes and elbows.

Figure 5:
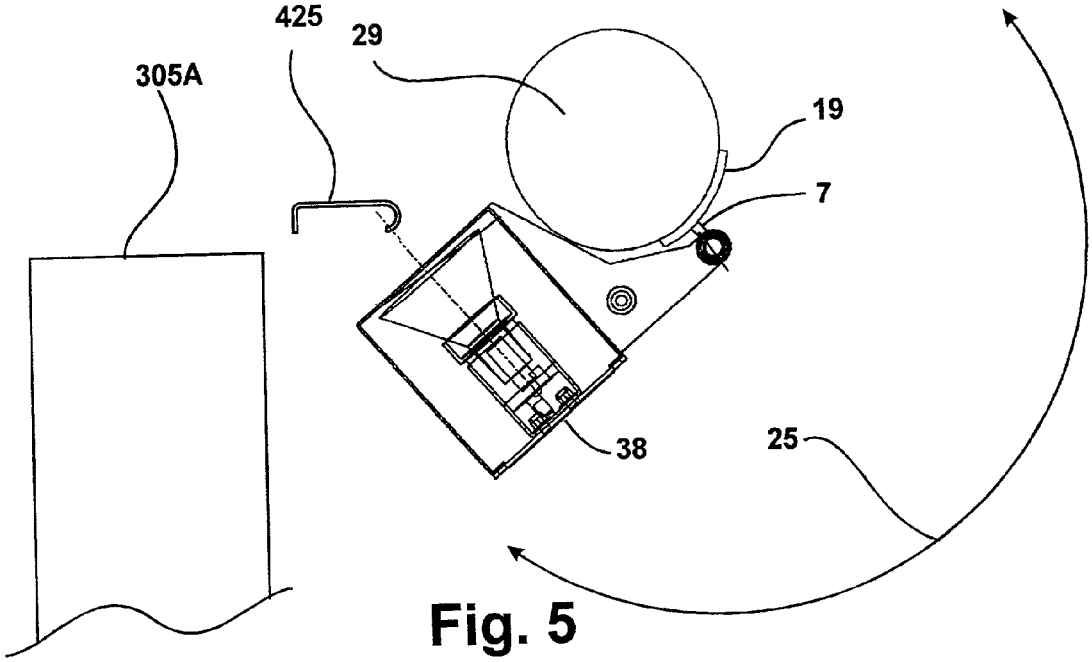
FIG. 5 is a top view of the short body pipe mount loading dock spot light head swung in front of the pipe bollard out of the way of fork truck traffic of the present invention.
Figure 6:
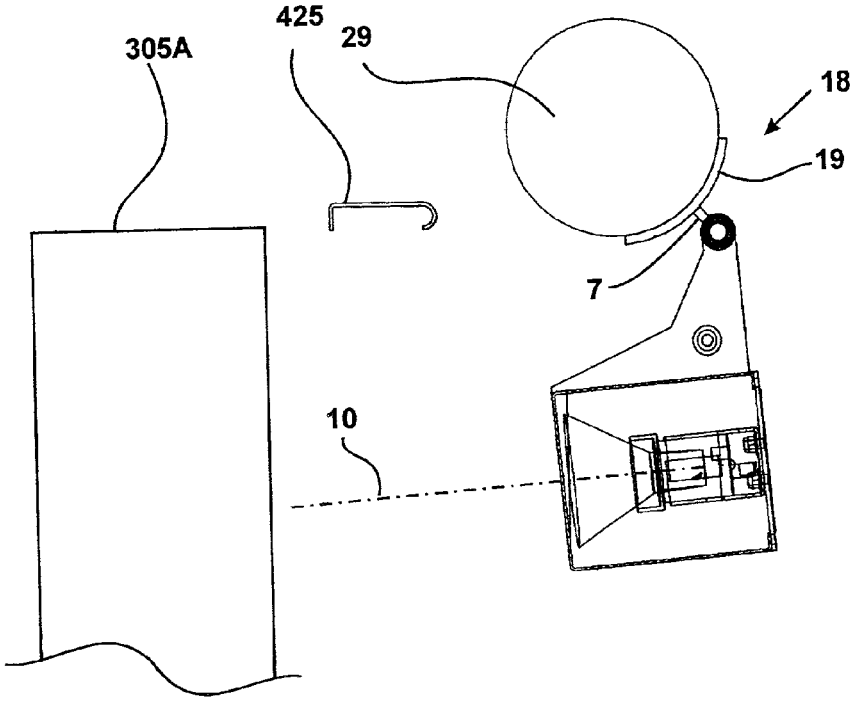
FIG. 6 is a top view of the short body pipe mount loading dock spot light swung in proper working position on the pipe bollard to illuminate the light at the proper angle inside the tractor trailer van of the present invention.
Figure 7A:
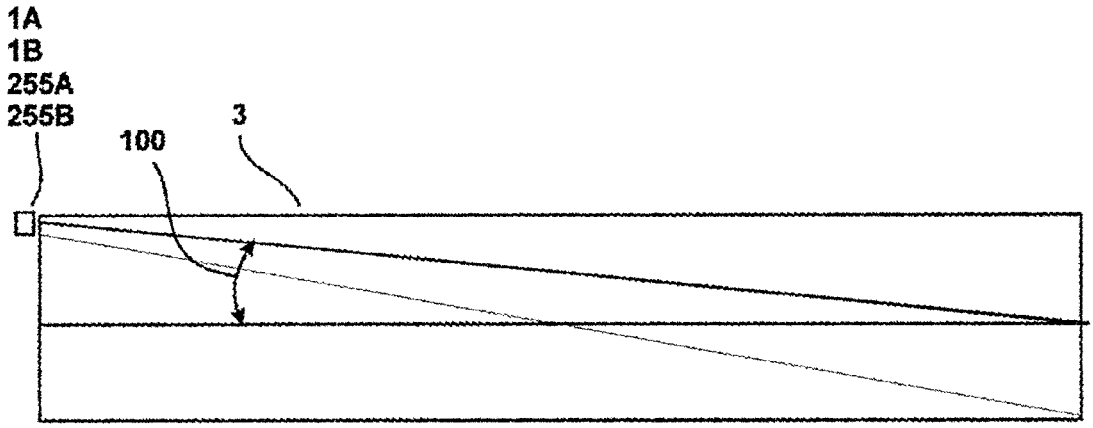
FIG. 7A is a side elevation illustration of the of the corner downlighting of the pipe mount and door jamb mount loading dock spot light on the right or left pipe bollard with shading representing specular trim lighting levels within a tractor trailer van of the present invention.
Figure 7B:
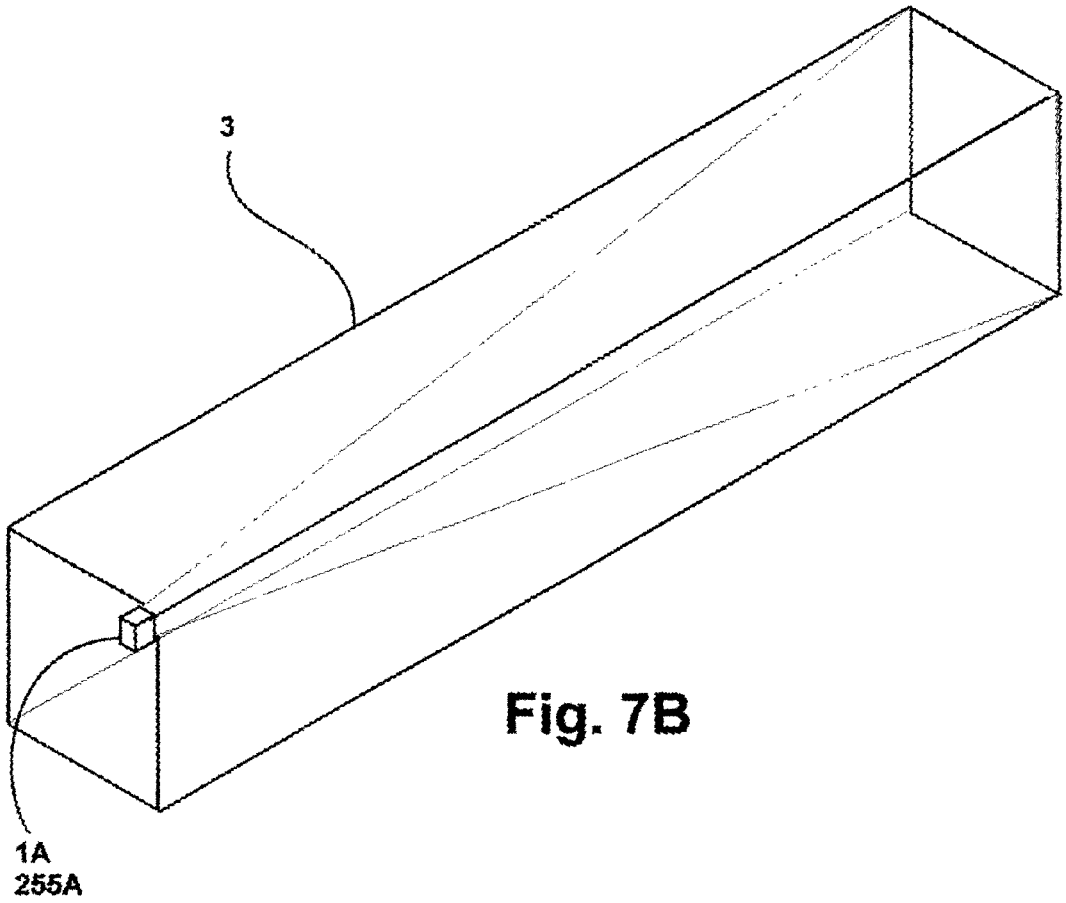
FIG. 7B is a perspective illustration of the of the corner downlighting of the pipe mount and door jamb mount loading dock spot light on the right pipe bollard with shading representing specular trim lighting levels within a tractor trailer van of the present invention.
Figure 7C:
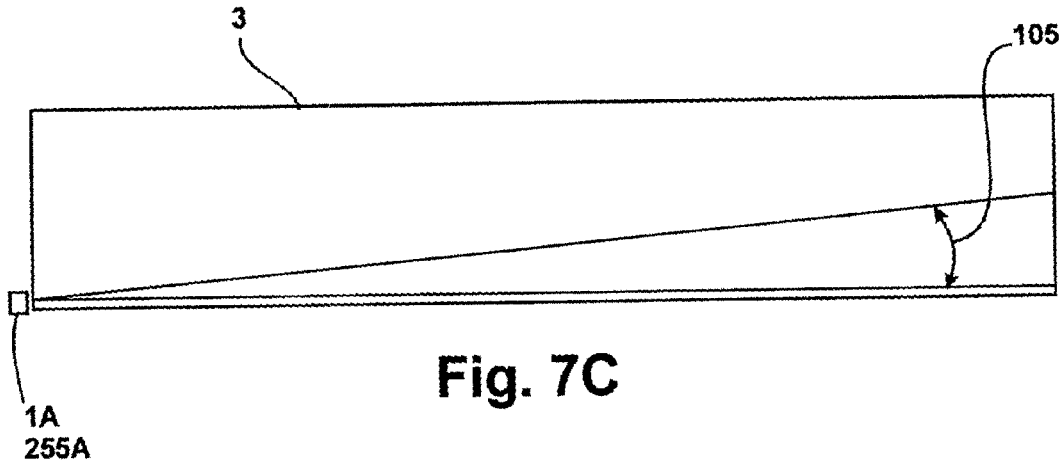
FIG. 7C is a top elevation illustration of the of the corner lighting of the pipe mount and door jamb mount loading dock spot light on the right pipe bollard with shading representing specular trim lighting levels within a tractor trailer van of the present invention.
Figure 7D:
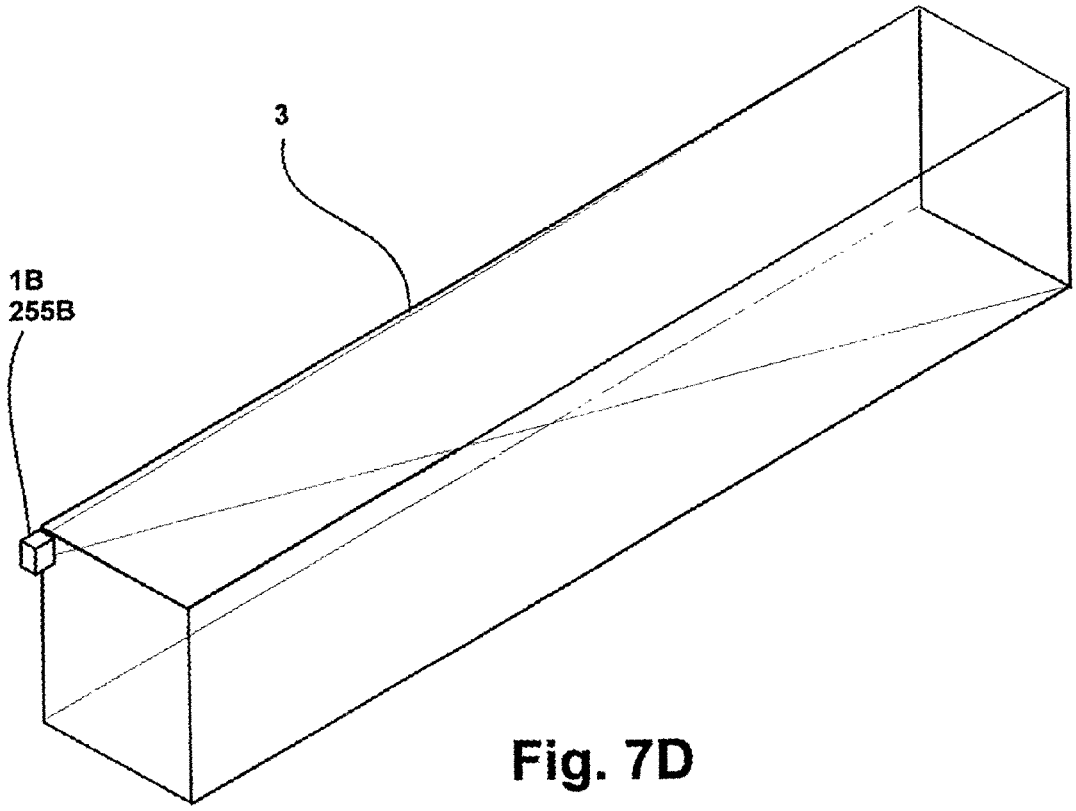
FIG. 7D is a perspective illustration of the of the corner downlighting of the pipe mount and door jamb mount loading dock spot light on the left pipe bollard with shading representing specular trim lighting levels within a tractor trailer van of the present invention.
Figure 8:
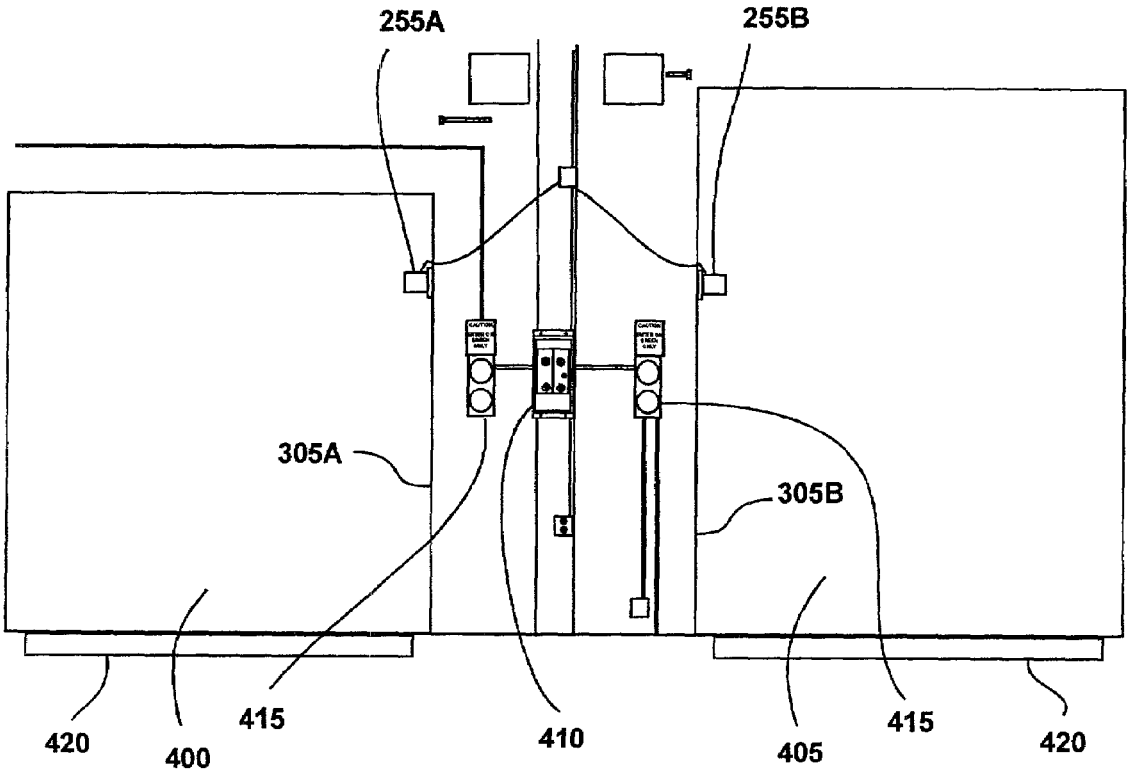
FIG. 8 is a view of a typical installation of the short body door jamb mount loading dock spotlight in a loading dock application.
Figure 9A:
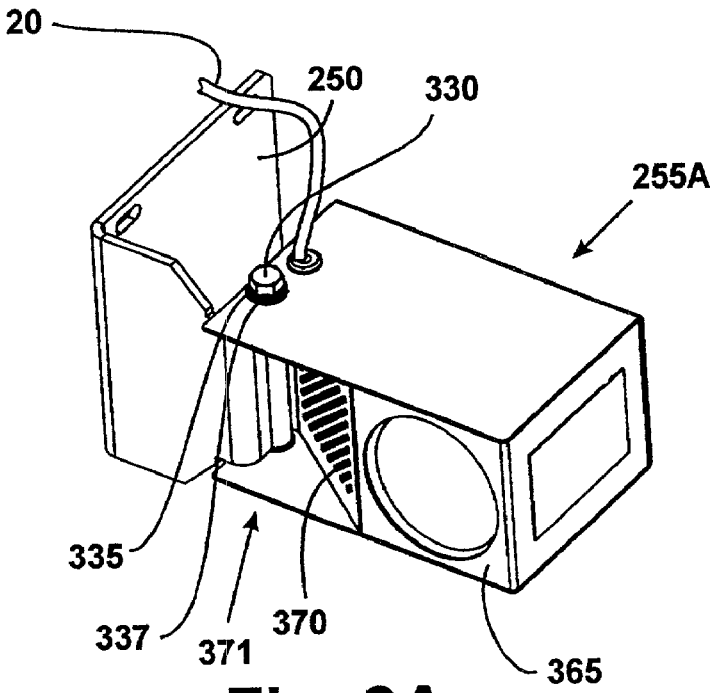
FIG. 9A is a perspective view of the short body door jamb mount loading dock spot light of the present invention shown in the orientation to be mounted on a right hand door jamb.
Figure 9B:
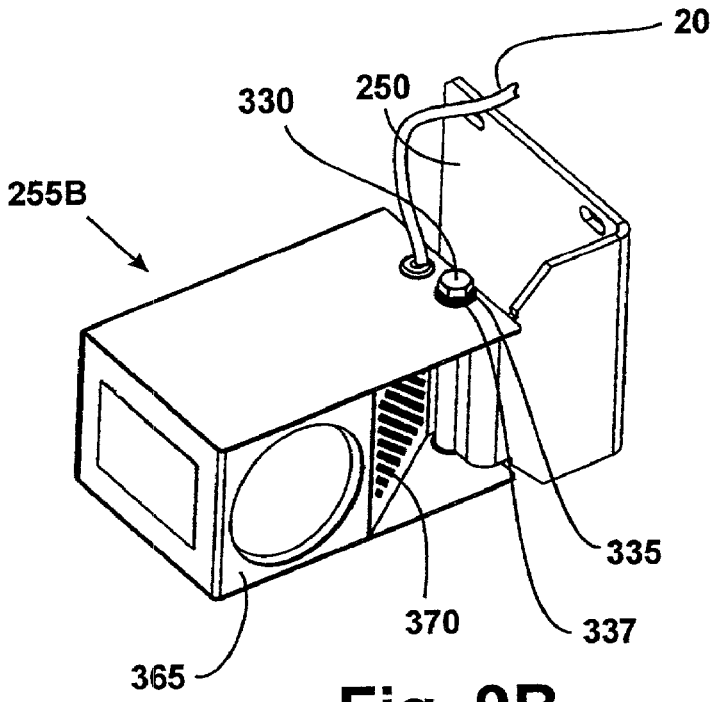
FIG. 9B is a perspective view of the short body door jamb mount loading dock spot light of the present invention shown in the orientation to be mounted on a left hand door jamb.
Figure 10:
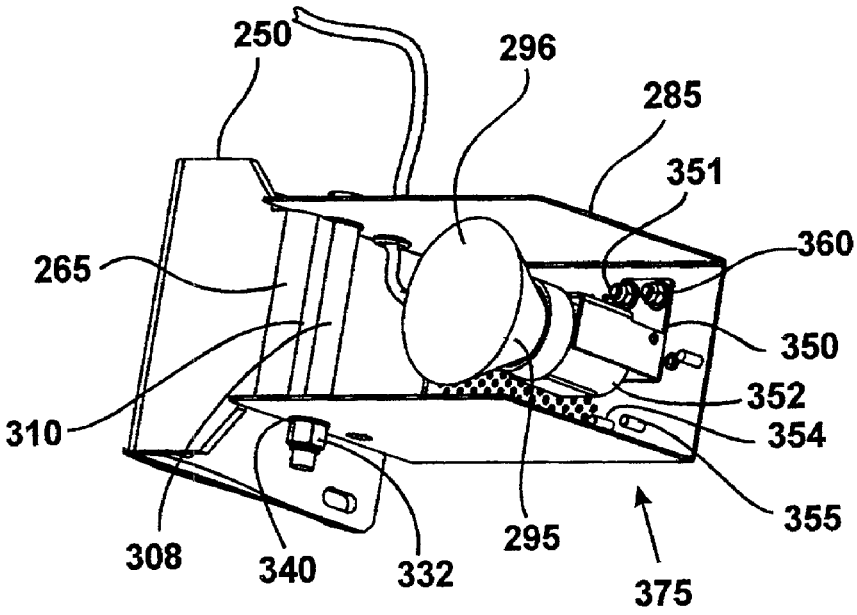
FIG. 10 is a perspective view of the short body door jamb mount loading dock spot light with the front cover removed illustrating the light bulb, light bulb fixture bracket and cooling space design of the present invention.
Figure 11:
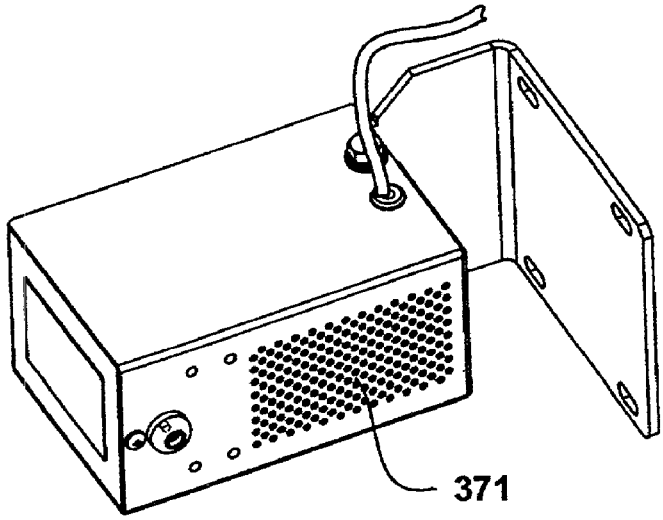
FIG. 11 is a perspective view of the short body door jamb mount loading dock spot light swung in proper working position away of the door jamb to illuminate the light at the proper angle inside the tractor trailer van of the present invention.
Figure 12:
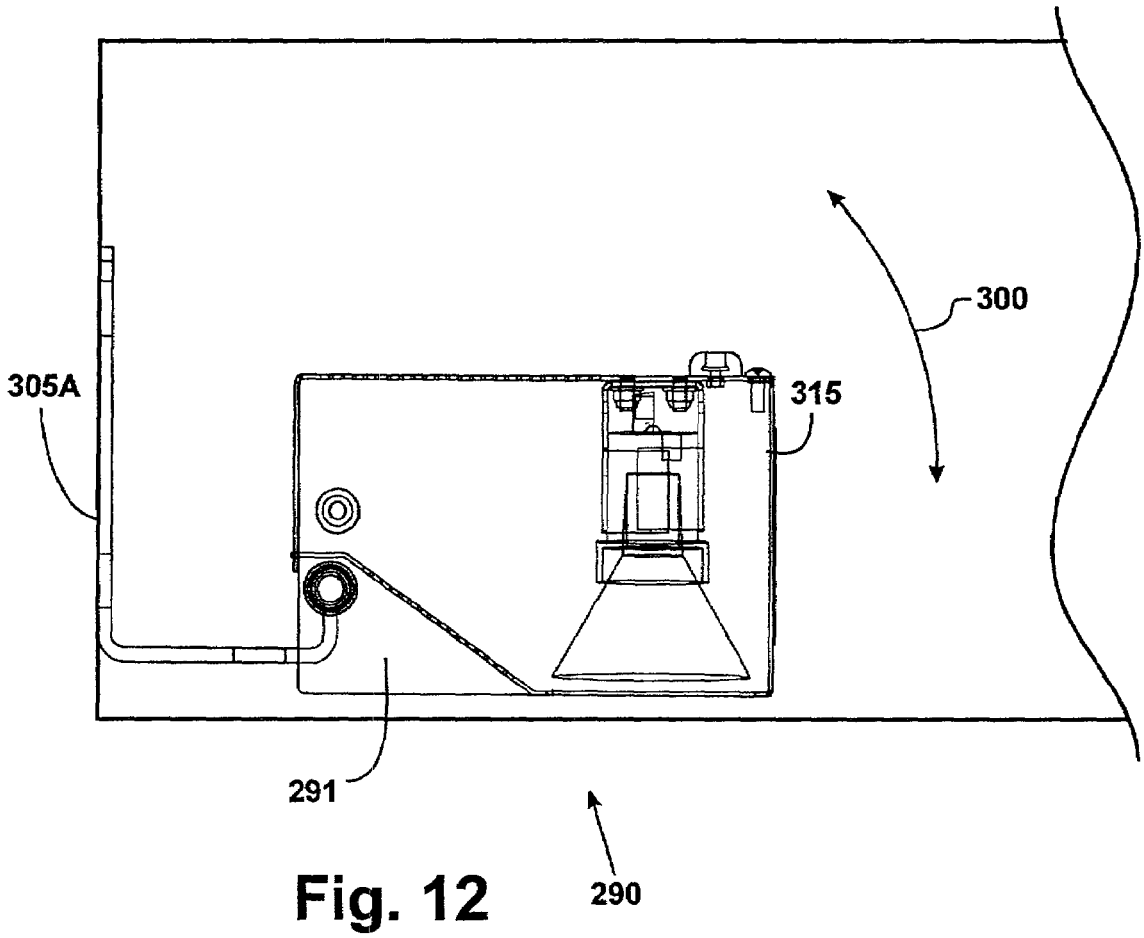
FIG. 12 is a top view of the short body door jamb mount loading dock spot light swung in proper working position with respect to the door jamb to reflect light at the proper angle inside the tractor trailer van
Figure 13A:
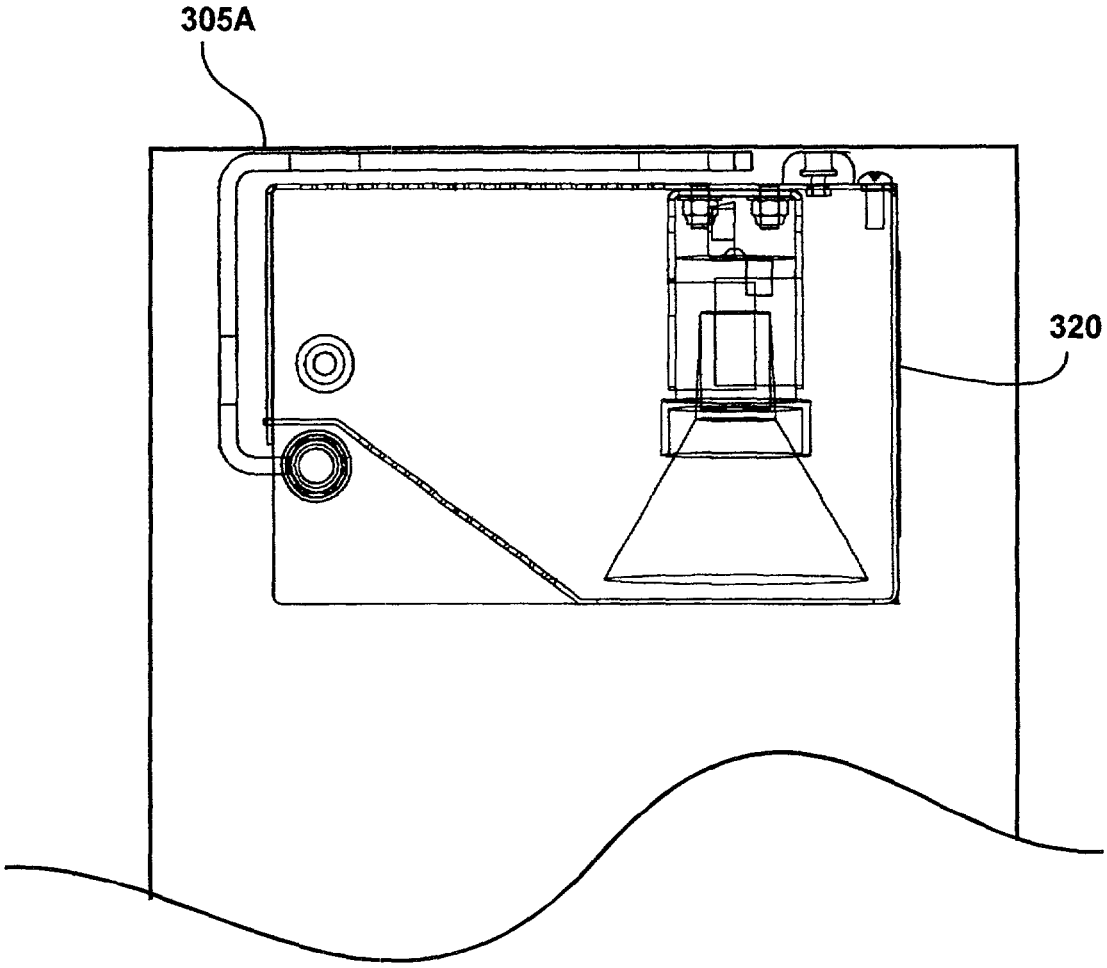
FIG. 13 is a top view of the short body door jamb mount loading dock spot light swung back in its stored position up against the door jamb out of the way of fork truck traffic.

The present invention pipe mount assembly is designed for horizontal axis movement as indicated at 25 (FIG. 5). The pipe mount assembly 1A of the present invention comprises a vertical curved mounting plate 19 to allow mounting to a right hand pipe bollard 29. Located on the vertical curved mounting plate is a hinge pipe assembly 35. The hinge pipe assembly 35 has adequate distance created by the hinge plate spacer 7 between the vertical curved mounting plate 19 and hinge pipe assembly 35 to ensure the body of the pipe mount light structure 8 with a proper degree of rotation 25 of 160 to 200 degrees. Electrical cord 20 is routed from pipe mount light structure 1A to a source of electrical power.

The pipe mount assembly 1B of the present invention comprises a vertical curved mounting plate 19 to allow mounting to a left hand pipe bollard 29. Located on the vertical curved mounting plate is a hinge pipe assembly 35. The hinge pipe assembly 35 has adequate distance created by the hinge plate spacer 7 between the vertical curved mounting plate 19 and hinge pipe assembly 35 to ensure the body of the pipe mount light structure 8 with a proper degree of rotation 25 of 160 to 200 degrees. Electrical cord 20 is routed from pipe mount light structure 1B to a source of electrical power.

This rotation 25 allows for the light body structure 1A, 1B of pipe mount loading dock light to move forward as indicated at 38 (FIG. 5) out of the way in the event the light body structure 1A, 1B is hit by a forklift from the rear as the fork truck is entering into the truck trailer. Also shown for clarity is door track 425 and right hand door jamb 305A.

Furthermore, this rotation 25 allows for the light body structure 1A, 1B to move backwards as indicated at 42 (FIG. 4) out of the way in the event the light body structure is hit by a forklift from the front as the fork truck is departing out of the truck trailer. Also shown for clarity is door track 425 and right hand door jamb 305A.

The pipe mount loading dock light hinge pin assembly 35 is made up of several components formulated to be adjustable for the light body swing rotation 25. The pin is a stainless steel bolt 50, with a nylon nut 58 at the bottom. As the unit is assembled the stainless steel bolt 50 enters through a steel washer 62, passes through a rubber washer 65, passes through the horizontal frame member of the light body structure 8 into through the hinge tube 35*a*, passes through the lower horizontal frame member of the light body 8, passes through a steel washer 72. Finally the nylon nut 58 is threaded onto the stainless bolt 50.

Figure 4:
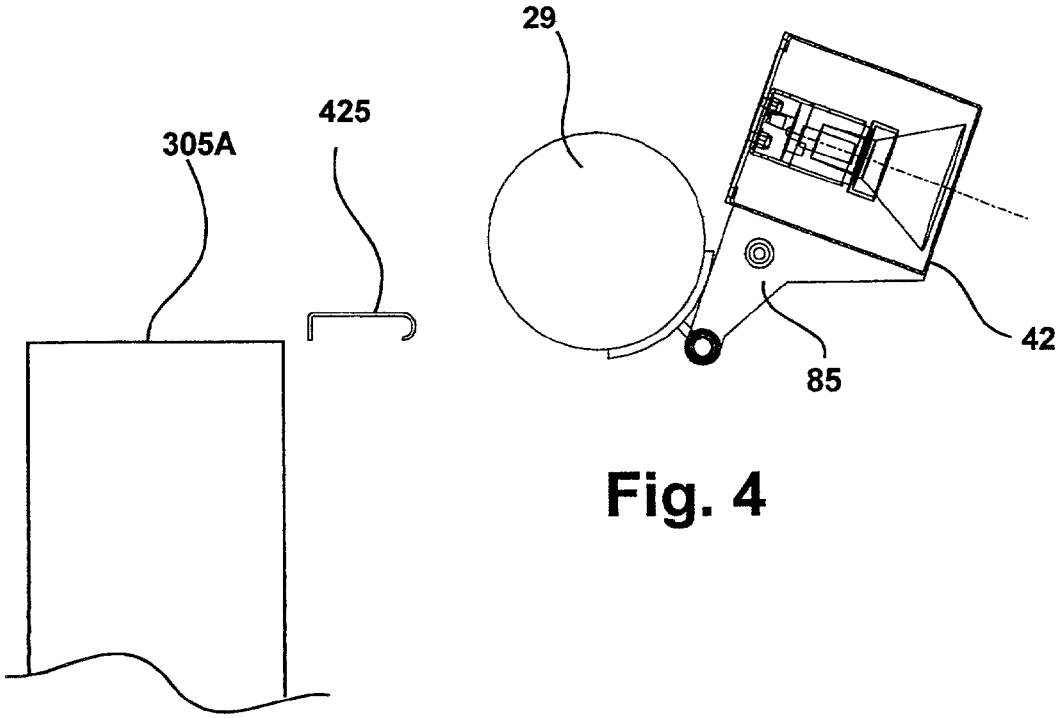
FIG. 4 is a top view of the short body pipe mount loading dock spot light swung behind the pipe bollard out of the way of fork truck traffic of the present invention.

The light body structure 1A, 1B of the pipe mount loading dock light has a geometric shape 85 giving it the ability to swing 38 in front of the pipe bollard 29 (FIG. 3), or behind 42 the pipe bollard 29 (FIG. 4). The light body structure 1A, 1B works in conjunction with the distance of the hinge spacer 7, the curved mounting plate 19, and 35 hinge tube assembly 35 to create this swing motion 25. Also shown for clarity is door track 425 and right hand door jamb 305A.

The present invention pipe mount loading dock light internal mounting frame 95 for the light bulb 15 has a predetermined horizontal angle 105 and a vertical angle 100. Vertical angle 100 of light bulb 15 for optimum lighting (FIG. 7A) is determined by the average length of semi tractor trailers 3 that are being serviced. The angle of the light bulb mounting bracket 95 determines the horizontal 105 and vertical 100 angles of light bulb 15. Angles 105, 100 of light bulb 15 determines the flood light density (FIGS. 7A and 7B) in the tractor trailer van. The example may vary due to height of light fixture, light bulb watt usage selection, light bulb flood degree selection, light bulb volts selection and surface reflectivity.

The pipe mount 18 loading dock light 1A, 1B of the present invention has an internal light housing fixture 120 that holds the light bulb 15 mounted on a universal frame 95 with the ability to rotate 180 degrees during operation. The design of the present invention including studs 130, 131, 134, 135 for the universal light body structure 95 allows the light structure to be mounted on the left or the right side pipe bollard that is located next to the loading dock door by rotating the mounting structure 180 degrees. During this operation the light body structures utilize the same parts for a left or right side light body structure.

As noted (FIGS. 2A and 2B), light body structure 1B is identical to that of light body structure 1A, except that it is mounted after being rotated 180 degrees with respect to light body structure 1A. To maintain vertical angle 100 and horizontal angle 105, internal mounting frame 95 is also rotated 180 degrees, being mounted to studs 130, 131 instead of studs 134, 135.

The pipe mount loading dock light present invention is designed to house a standard par 30 Halogen light bulb 15 as the illuminator. The light bulb face 15A of the present invention is behind the front face 145 of the light body structure. The light body structure of the present invention is designed of strong metal, metal alloy or plastic for the purpose of taking an impact from a fork truck before light bulb 15 is hit.

The pipe mounted loading dock spot light assembly of present invention is an environmentally cooled structure. Since the present assembly is cool to the touch it can be manually swung as indicated at 25 and moved around the pipe bollard 29 for proper light positioning for loading and unloading procedures within the FIGS. 7A and 7B truck trailer van 3. The light body structure of the present invention has breather holes 156 to keep the body 1A, 1B cool to the touch. This light body structure also keeps cool by the internal breathing design 158.

The light body structure of the pipe mount loading dock light of the present invention is designed to be short as indicated by the short outward extension of hinge spacer 7 relative and to its mounting point hinge assembly 18. Thus the light body structure of the present invention is designed not to have sagging arms or tubes as many other loading dock lights can do after time.

FIGS. 7A through 13 illustrate the Door Jamb Loading Dock Light embodiment of the device of the present invention.

The standard loading dock lights for loading and unloading tractor trailer vans usually have long cumbersome arms and get damaged easily in heavy traffic areas at loading dock facilities. Door jamb loading dock lights 255A and 255B are shown in a typical installation (FIG. 8), mounted to right door jamb 305A and left door jamb 305B, respectively. Some or all of the following items may not be present in all installations: Left door 400, right door 405, dock levelers 420, traffic signal lights 415 and control panel 410.

The advantage of the present invention door jamb loading dock light 255A, 255B is to light the inside of tractor trailer van 3 during loading and unloading procedures with the proper geometry frame light structure without the requirement of long arms or tube extension structures.

The advantage of the door jamb loading dock light 255A, 255B present invention is a thick strong frame 265, 275 and housing 285 that has a better ability to take the rugged day to day operations than the current loading dock light designs with arm extensions, tubes and elbows.

Another advantage of the present invention is rotation utilizing assembly 250 in place of long arms and elbowed structures. The proper lighting geometry 291 of the present invention increases the life of the overall frame body structure 265, 275, 285 in comparison to the present loading dock lights with extension arms, tubes and elbows. With the light body structure 255A, 255B having its reduced exposure in the traffic area, the light bulb 295 filament life increases in relationship to the current loading dock lights with long arm extensions, tubes and elbows.

The present invention door jamb loading dock light assembly 255A is designed for horizontal axis. movement 300. The door jamb design assembly of the present invention comprises a vertical mounting plate 250 to allow mounting to a right hand door jamb 305A Located to the formed mounting plate 250 is a hinge pipe assembly 308. The hinge pipe assembly 308 has adequate distance created by the hinge spacer 310 between the vertical mounting plate 250 to ensure the body 255A of the door jamb light structure with a proper rotation 300.

The present invention door jamb loading dock light assembly 255B is designed for horizontal axis movement 300. The door jamb design assembly of the present invention comprises a vertical mounting plate 250 to allow mounting to a left hand door jamb 305B. Located to the formed mounting plate 250 is a hinge pipe assembly 308. The hinge pipe assembly 308 has adequate distance created by the hinge spacer 310 between the vertical mounting plate 250 to ensure the body 255B of the door jamb light structure with a proper rotation 300.

This rotation 300 allows for the light body structure 255A, 255B to move forward as indicated at 315 out of the way in the event the light body structure 255A, 255B is hit by a forklift truck from the rear as the fork truck is entering into the truck trailer.

Furthermore, the rotation 300 allows for the light body structure 255A, 255B to move backwards as indicated at 320 and out of the way in the event the light body structure is hit by a forklift truck from the front as the truck is departing out of the truck trailer.

The door jamb mount loading dock hinge pin 371 is made up of several components formulated to be adjustable for the light body 255A, 255B to swing in tension. The pin is a 330 stainless steel bolt, with a nylon nut 332 at the bottom. As the unit is assembled the stainless steel bolt 330 enters through a steel washer 335, passes through another washer 337, preferably made of elastometric material such as rubber, passes through the horizontal frame member 285 of the light body structure 255A, 255B, into and through the hinge tube 308, passes through the lower horizontal frame member 285 of the light body 255A, 255B, passes through a steel washer 340 and the nylon nut 332 is threaded onto the 330 stainless bolt.

The light body structure 255A, 255B of the door jamb loading dock light has a geometric shape design 291 giving it the ability to swing as indicated at 300 in working position away from the door jamb 305A, 305B. The design of the light body structure 255A, 255B works in conjunction with the distance of the hinge spacer 310 and the formed mounting plate 250 and hinge tube 308 assembly to create this swing motion 300. The door jamb design of the present invention creates the light body structure 255A, 255B to be behind the dock door seal out of the way of fork truck traffic when in the stored position 320.

The present invention door jamb loading dock light 255A, 255B internal mounting frame 350 for the light bulb 295 has a predetermined horizontal 105 and vertical 100 angle degree. The vertical angle 100 of the light bulb 295 for optimum lighting (FIG. 7A) is determined by the average length of semi tractor trailers that are being serviced. The angle of the light bulb mounting bracket 350 determines the angles 100, 105 of the light bulb 295. The angles 100, 105 of the light source 295 determines the flood light density in FIGS. 7A and 7C, respectively of the tractor trailer van.

The door jamb loading dock internal light housing fixture 352 that holds the light bulb 295 is mounted on a universal frame 350 with the ability to rotate 180 degrees during operation. The design of the present invention including studs 360, 351, 354 and 355 for the universal light body structure 350 allows the light structure to be mounted on the left or the right side door jamb of the loading dock door structure by rotation of 180 degrees. During operation the light body structures utilize the same parts for a left or right side light body structure.

As noted (FIGS. 9A and 9B), door jamb loading dock light 255B is identical to that of door jamb loading dock light 255A, except that it is mounted after being rotated 180 degrees with respect to door jamb loading dock light 255A. To maintain vertical angle 100 and horizontal angle 105, internal mounting frame 350 is also rotated 180 degrees, being mounted to studs 355, 354 instead of studs 351, 360.

The door jamb loading dock light assembly 255A, 255B of the present invention is designed to house a standard par 30 Halogen light bulb 295. The light body structure 255A, 255B of the present invention is designed to use the light bulb 295 as the illuminator. The light bulb face 296 is behind the front face 365 of the light body structure 255. The light body structure of the present invention is made of strong metal, metal alloy or strong plastic for the purpose of taking an impact from a fork truck before the light bulb 295 is hit.

The door jamb loading dock spot light of present invention is an environmentally cooled structure. Since the assembly 255A, 255B of present invention is cool to the touch it can be manually swung as indicated at 300 and moved around away from the door jamb 305A for proper light positioning for loading and unloading procedures within the FIGS. 7A and 7B truck trailer van. The light body structure of the present invention has breather holes 370, 371 to keep the body 255A, 255B cool to the touch. This light body structure also keeps cool by the internal breathing design 375.

The light body structure 255A, 255B of the present invention is designed to be short in its connection to its mounting point hinge assembly 308. The light body structure 255A, 255B of the present invention is designed to avoid sagging arms or tubes as many other loading dock lights can do after time.

What is claimed is:

1. A loading dock light assembly comprising:

a vertical curved mounting plate adapted to be mounted to a pipe bollard;

a hinge pipe assembly located on said vertical curved mounting plate;

said hinge pipe assembly having a spaced distance between said vertical curved mounting plate and said hinge pipe assembly to ensure the body of the pipe mount light structure has a degree of rotation of 160 to 200 degrees, which allows said light body structure to move forward out of the way in the event the light body structure is hit by a forklift from the rear as the fork truck is entering into the truck trailer; and to move backwards out of the way in the event the light body structure is hit by a forklift from the front as the fork truck is departing out of the truck trailer.

2. A loading dock light according to claim 1 wherein said mounting of the pipe bollard light fixture allows the light to swing in front of the bollard in the working position.

3. A loading dock light according to claim 1 wherein said mounting of the pipe bollard light fixture allows the light to swing in behind of the bollard out of the working position.

4. A loading dock light according to claim 1 wherein the design of bulb location, and cooling holes provides a cool surface to the touch.

5. A loading dock light according to claim 4 wherein the light bulb is mounted in an adjustable fixed head design.

6. A loading dock light according to claim 4, wherein said hinge design of the light fixture includes a horizontal axis swing design allowing the light fixture to swing in and out on a fixed horizontal plane without sagging.

7. A loading dock light according to claim 4, wherein said design of the light fixture includes a standard par 30 light bulb.

8. A loading dock light assembly according to claim 1 wherein said spaced distance is created by at least one spacer.

9. A loading dock light assembly according to claim 8 wherein said hinge assembly comprises a vertical pin with fastening means at the top and bottom of said assembly.

10. A loading dock light assembly according to claim 9 wherein said assembly comprises a stainless steel bolt with a head at the top and a nylon nut at the bottom.

11. A loading dock light assembly according to claim 10 wherein said stainless steel bolt enters from the top of the assembly, passes through a steel washer, passes through a rubber washer, passes through a horizontal frame member of the light body structure, through the hinge tube, passes through a lower horizontal frame member of the light body, passes through a steel washer; and a nylon nut is threaded onto said stainless bolt.

12. A loading dock light according to claim 11 wherein said mounting of the door jamb light fixture allows the light to swing in behind the door seal and up against the door jamb and out of the working position and traffic zone.

13. A loading dock spot light comprising:

a light body, a light source, mounting means, comprising at least one vertically extending mounting plate which is curved to fit on a pipe bollard in the case of a pipe mounted light, safe handling means to prevent burns to loading dock personnel, means to convert from left to right hand mounting; and means for connecting said light source to an electrical source.

14. A loading dock spot light according to claim 13 having a light body comprising a housing, a frame, and means to mount a light source.

15. A loading dock spot light according to claim 14 wherein said housing provides protection to internal elements.

16. A loading dock spot light according to claim 14 wherein said frame provides means to mount said light body to a permanent structure, and provides means to mount components of said light body.

17. A loading dock spot light according to claim 14 wherein said means to mount a light source comprises an internal fixture.

18. A loading dock spot light according to claim 17 wherein said internal fixture has a predetermined vertical and horizontal mounting angle which aims the light for optimum coverage inside a semi tractor trailer van.

19. A loading dock spot light according to claim 13 having a light source which comprises a standard small diameter par 30 halogen light bulb.

20. A loading dock spot light according to claim 17 having mounting means comprising at least one additional mounting plate, hinges, and fasteners.

21. A loading dock spot light according to claim 20 wherein said hinges permit free angular rotational motion of said spot light while providing means for it to remain firmly in one position.

22. A loading dock spot light according to claim 20 wherein said fasteners comprise elements selected from bolts, nuts, and washers.

23. A loading dock spot light according to claim 22 wherein said washers includes at least one which is made from elastometric material which material will provide resistance to motion when said nut and bolt are tightened.

24. A loading dock spot light according to claim 13 including safe handling means comprising vent holes and internal free air space.

25. A loading dock spot light according to claim 24 wherein said vent holes are located in at least one of the housing and frame area so as to allow hot air to escape from said housing.

26. A loading dock spot light according to claim 24 wherein said internal free air space is sufficient to allow diffusion of radiant and convective heat from said halogen light bulb prior to being transferred to said housing and frame.

27. A loading dock spot light according to claim 13 wherein the means to convert said said spot light from left hand to right hand mounting, and vise versa occurs without additional parts.

28. A loading dock spot light according to claim 27 wherein said means to convert comprises a plurality of internal mounting studs which allows said light fixture to be mounted in one of two positions to maintain said horizontal and vertical mounting angles.

29. A loading dock spot light according to claim 13 having means to connect said spot light to a source of electrical power comprising a length of electrical cable passing through said housing.

30. A loading dock spot light according to claim 20 wherein in the case of the door jamb mounted light, said mounting means comprises a mounting plate having a flat portion to fit a door jam in the case of the door jamb mounted light.

31. A loading dock light assembly comprising:

a vertical L shaped mounting plate having a pair of legs about 90 degrees apart and means for mounting one of said legs on a door jamb;

means for mounting a hinge pipe assembly having a light on said second leg; said hinge pipe assembly having a spaced distance between said vertical mounting plate and said hinge pipe assembly to ensure that the body of the pipe mount structure allows said light to swing behind the door seal and against the door jamb out of the working position and traffic zone; and wherein said mounting of the door jamb light fixture allows said light to swing out and away from the door jamb in a working position.

32. A loading dock light according to claim 19 wherein said mounting of the door jamb light fixture allows the light to swing away from the door jamb and into working position.

33. A loading dock light assembly comprising:

a vertical curved mounting plate adapted to be mounted to a pipe bollard;

a hinge pipe assembly located on said vertical curved mounting plate;

said hinge pipe assembly having a spaced distance between said vertical curved mounting plate and said hinge pipe assembly to ensure the body of the pipe mount light structure has a degree of rotation of 160 to 200 degrees, which allows said light body structure to move forward out of the way in the event the light body structure is hit by a forklift from the rear as the fork truck is entering into the truck trailer; and to move backwards out of the way in the event the light body structure is hit by a forklift from the front as the fork truck is departing out of the truck trailer.

* * * * *